US005280834A

United States Patent [19]

Berkley

[11] Patent Number: 5,280,834

[45] Date of Patent: Jan. 25, 1994

[54] CONTACT LENS DATE STORAGE CONTAINER

[76] Inventor: Bruce A. Berkley, 410 Delaware, Downs, Kans. 67437

[21] Appl. No.: 976,576

[22] Filed: Nov. 16, 1992

[51] Int. Cl.[5] ..... A45C 11/04; G09F 9/00

[52] U.S. Cl. ..... 206/5.1; 40/484; 40/495; 116/309; 116/312; 116/315; 134/901; 206/459.1; 422/301

[58] Field of Search ..... 206/5.1, 459.1; 134/901; 116/309, 312, 315, 308; 40/484, 495; 422/301

[56] References Cited

U.S. PATENT DOCUMENTS 2,874,672 2/1959 Hamm, Jr. ..... 116/315 X
3,960,713 6/1976 Carey ..... 206/459.1 X
4,573,580 3/1986 Messer ..... 206/459.1 X
5,046,605 9/1991 Levrant ..... 206/5.1

*Primary Examiner*—Bryon P. Gehman
*Attorney, Agent, or Firm*—Leon Gilden

[57] ABSTRACT

A storage container includes a base housing having first and second containers mounted to the housing. The base housing includes a cavity therewithin, having a rotatable dial projecting through a first side wall of the housing. The dial includes sequential digits visible through a window in a top wall of the housing, wherein sequential days are counted relative to contact lenses, and particularly disposable contact lenses stored within the first and second containers.

4 Claims, 4 Drawing Sheets

30
34
32
33

37
14
27
26
31
30
34
32
33
35
28
13
8
8
18
19
21
36

15a
39

16a
38
11
11

38

36

CONTACT LENS DATE STORAGE CONTAINER

BACKGROUND OF THE INVENTION

1. Field of the Invention

The field of invention relates to contact lens storage apparatus, and more particularly pertains to a new and improved contact lens date storage container wherein the same permits the visible notation of time passage for counting days worn of disposable contact lenses.

2. Description of the Prior Art

Contact lenses, and particularly disposable contact lenses, are worn for a predetermined period of days and then disposed. To provide for date notation and time passage relative to the contact lenses, the instant invention attempts to overcome deficiencies of the prior art by providing for a storage container having a rotary dial to provide for visual indication of time passage. Prior art contact lens cases such as indicated in U.S. Pat. Nos. 4,826,001; 4,838,413; 4,909,382; and 4,925,017 are examples of prior art contact lens storage containers wherein the same do not provide for the convenience and ease of use of the construction of the instant invention providing for the visual indication of time passage relative to a contact lens wearing event and in this respect, the present invention substantially fulfills this need.

SUMMARY OF THE INVENTION

In view of the foregoing disadvantages inherent in the known types of contact lens storage apparatus now present in the prior art, the present invention provides a contact lens date storage container wherein the same utilizes a rotary dial to indicate time passage relative to insertion of disposable contact lenses relative to an individual's eyes. As such, the general purpose of the present invention, which will be described subsequently in greater detail, is to provide a new and improved contact lens date storage container which has all the advantages of the prior art contact lens storage apparatus and none of the disadvantages.

To attain this, the present invention provides a storage container including a base housing having first and second containers mounted to the housing. The base housing includes a cavity therewithin, having a rotatable dial projecting through a first side wall of the housing. The dial includes sequential digits visible through a window in a top wall of the housing, wherein sequential days are counted relative to contact lenses, and particularly disposable contact lenses stored within the first and second containers.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved contact lens date storage container which has all the advantages of the prior art contact lens storage apparatus and none of the disadvantages.

It is another object of the present invention to provide a new and improved contact lens date storage container which may be easily and efficiently manufactured and marketed.

It is a further object of the present invention to provide a new and improved contact lens date storage container which is of a durable and reliable construction.

An even further object of the present invention is to provide a new and improved contact lens date storage container which is susceptible of a low cost of manufacture with regard to both materials and labor, and which accordingly is then susceptible of low prices of sale to the consuming public, thereby making such contact lens date storage containers economically available to the buying public.

Still yet another object of the present invention is to provide a new and improved contact lens date storage container which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
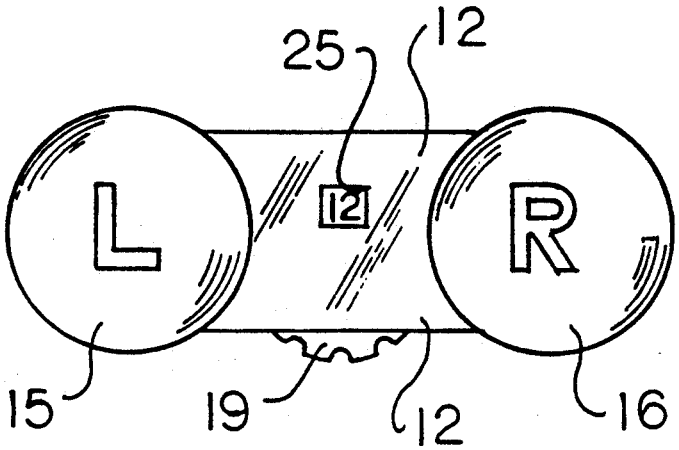
FIG. 1 is an orthographic top view of the invention.
Figure 2:
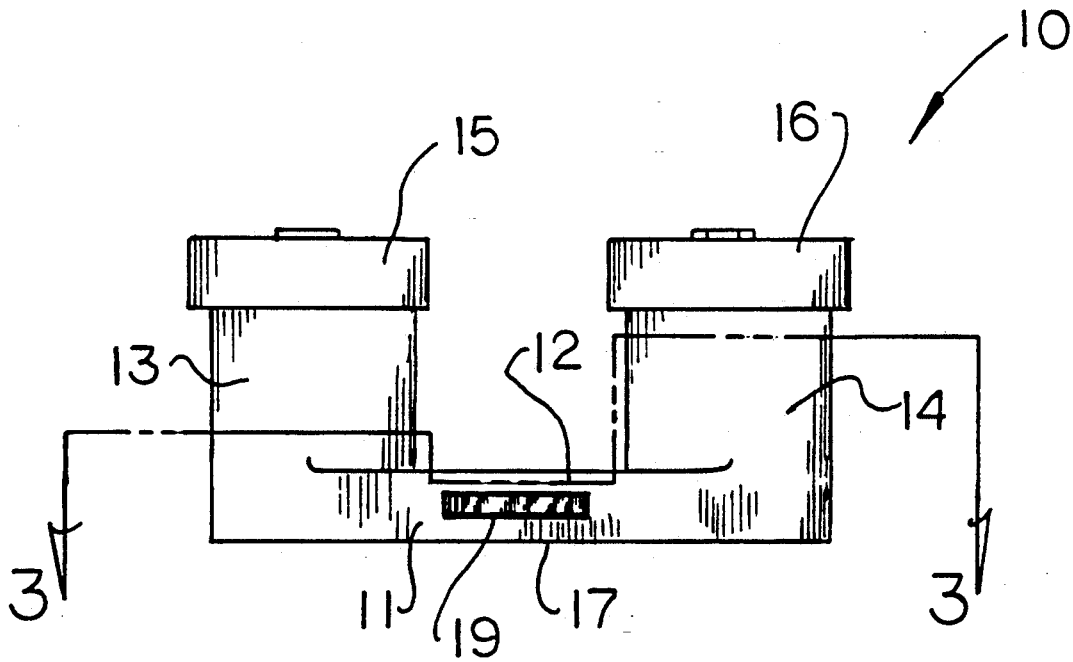
FIG. 2 is an orthographic side view of the invention.

With reference now to the drawings, and in particular to FIGS. 1 to 11 thereof, a new and improved contact lens date storage container embodying the principles and concepts of the present invention and generally designated by the reference numeral 10 will be described.

Figure 3:
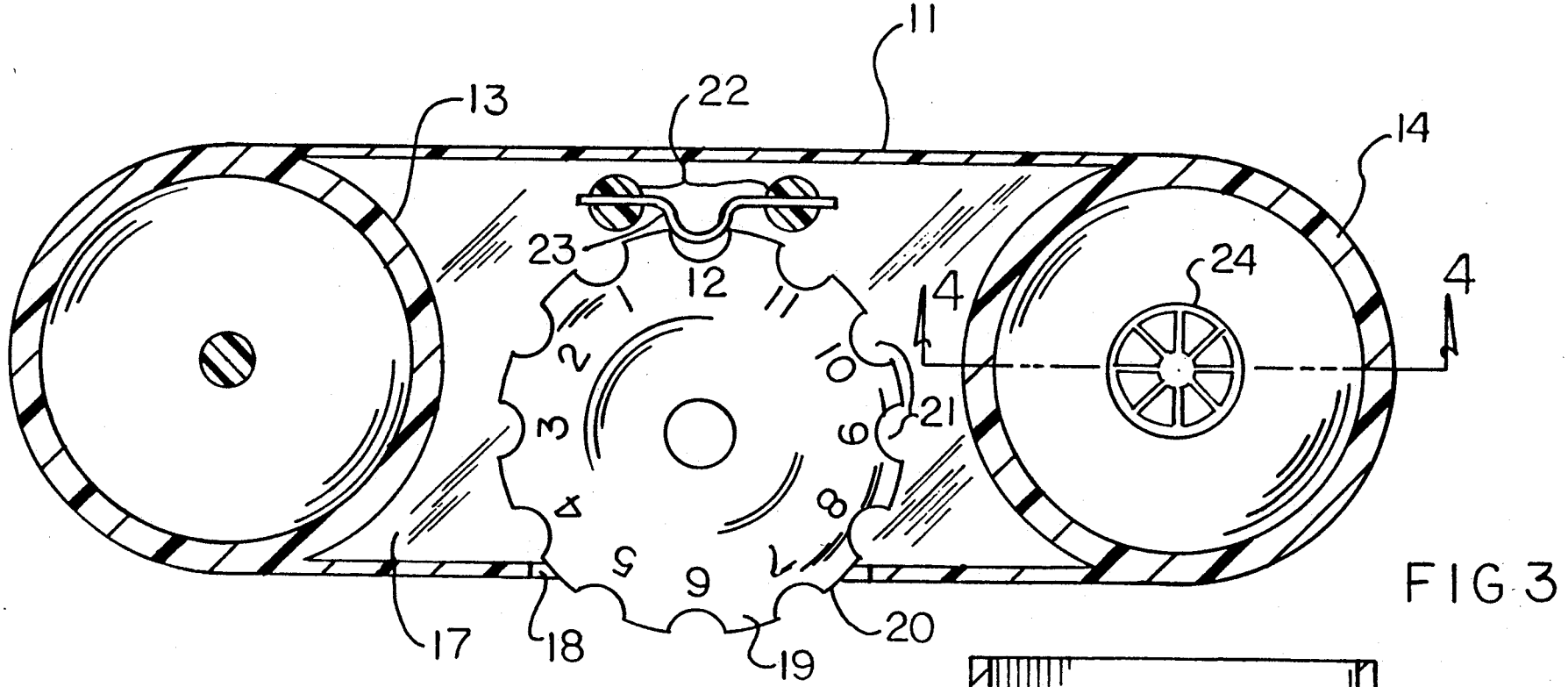
FIG. 3 is an orthographic view, taken along the lines 3—3 of FIG. 2 in the direction indicated by the arrows.
Figure 4:
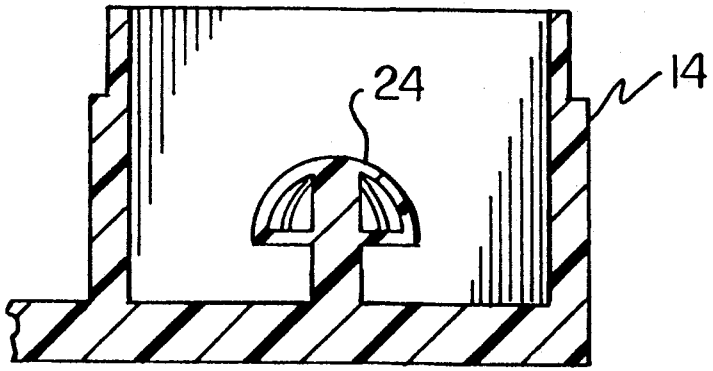
FIG. 4 is an orthographic view, taken along the lines 4—4 of FIG. 3 in the direction indicated by the arrows.

More specifically, the contact lens date storage container 10 of the instant invention essentially comprises a base housing 11 mounting a first container 13 and a second container 14 in a spaced parallel relationship relative to one another orthogonally to a housing top wall 12 of the housing 11. The first container 13 is mounted to a first end of the top wall 12, with the second container mounted to a second end of the top wall 12. A first lid 15 and a second lid 16 are respectively secured to upper ends of the first and second containers 13 and 14 to provide for reception of storage of contact lenses therewithin the first and second containers in a conventional manner. The base housing further includes a base housing floor 17 (see FIG. 3 for example) defining a housing cavity between the housing floor 17 and the top wall 12. A housing first slot 18 is directed through a first of the side walls of the housing 11 intermediate the first and second containers 13 and 14. A rotary dial 19 rotatably mounted about a dial axle within the cavity of the housing includes an annular edge 20, with spaced notches 21 spaced at equal predetermined intervals within the annular edge 20. The structure of the FIG. 3 indicates spaced resilient lugs 22 mounting a U-shaped spring plate 23, with the U-shaped spring plate arranged for reception within one of the notches 21 to maintain the dial in a predetermined angular orientation relative to the slot to project a digit imparted upon a top surface of the dial through a top wall window 25 (see FIG. 1) for viewing. In this manner, sequential days for use of contact lenses are indicated. While twelve days are indicated in association with twelve notches, it should be understood that any desired interval period may be indicated by utilizing an equal number of digits and notches, in a manner as illustrated in FIG. 3. The first and second containers 13 and 14 include umbrella supports 24 for positioning a contact lens thereon. The umbrella supports are formed of a semi-spherical configuration of semi-annular ribs.

Figure 5:
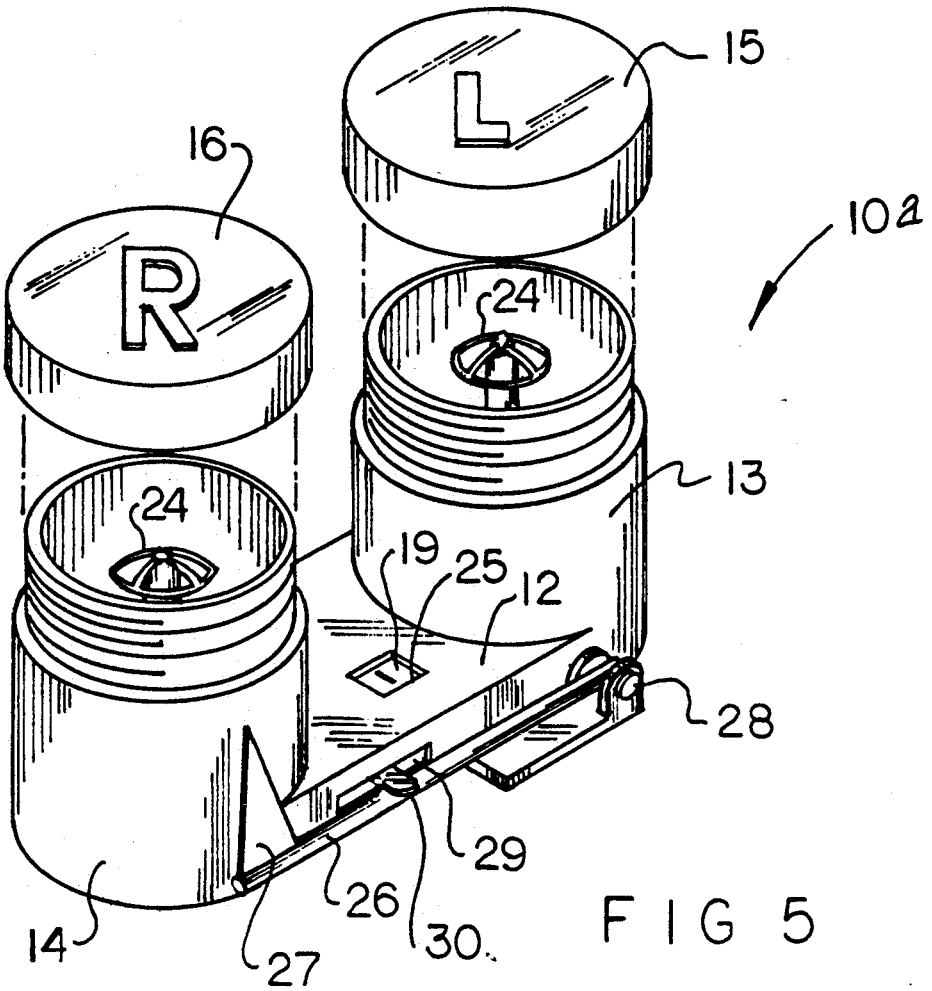
FIG. 5 is an isometric illustration of a modified storage container structure.
Figure 6:
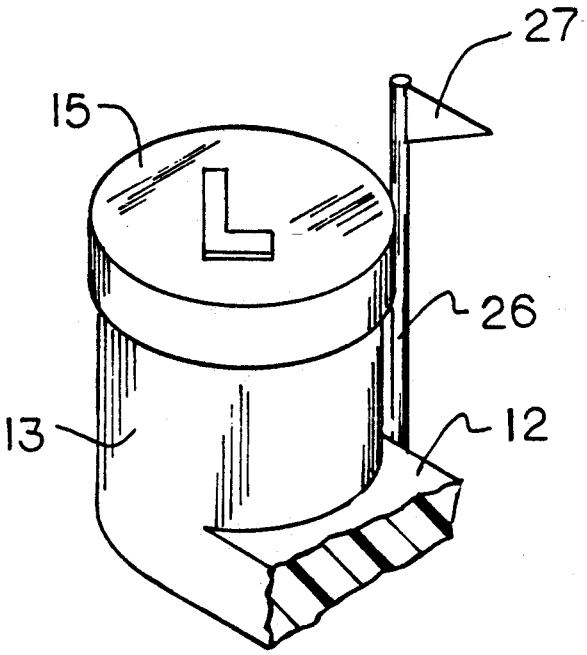
FIG. 6 is an isometric partial view of the indicator flag in a raised second position from a first position, as indicated in FIG. 5.
Figures 7, 7A, 8, 9, 10, 11:
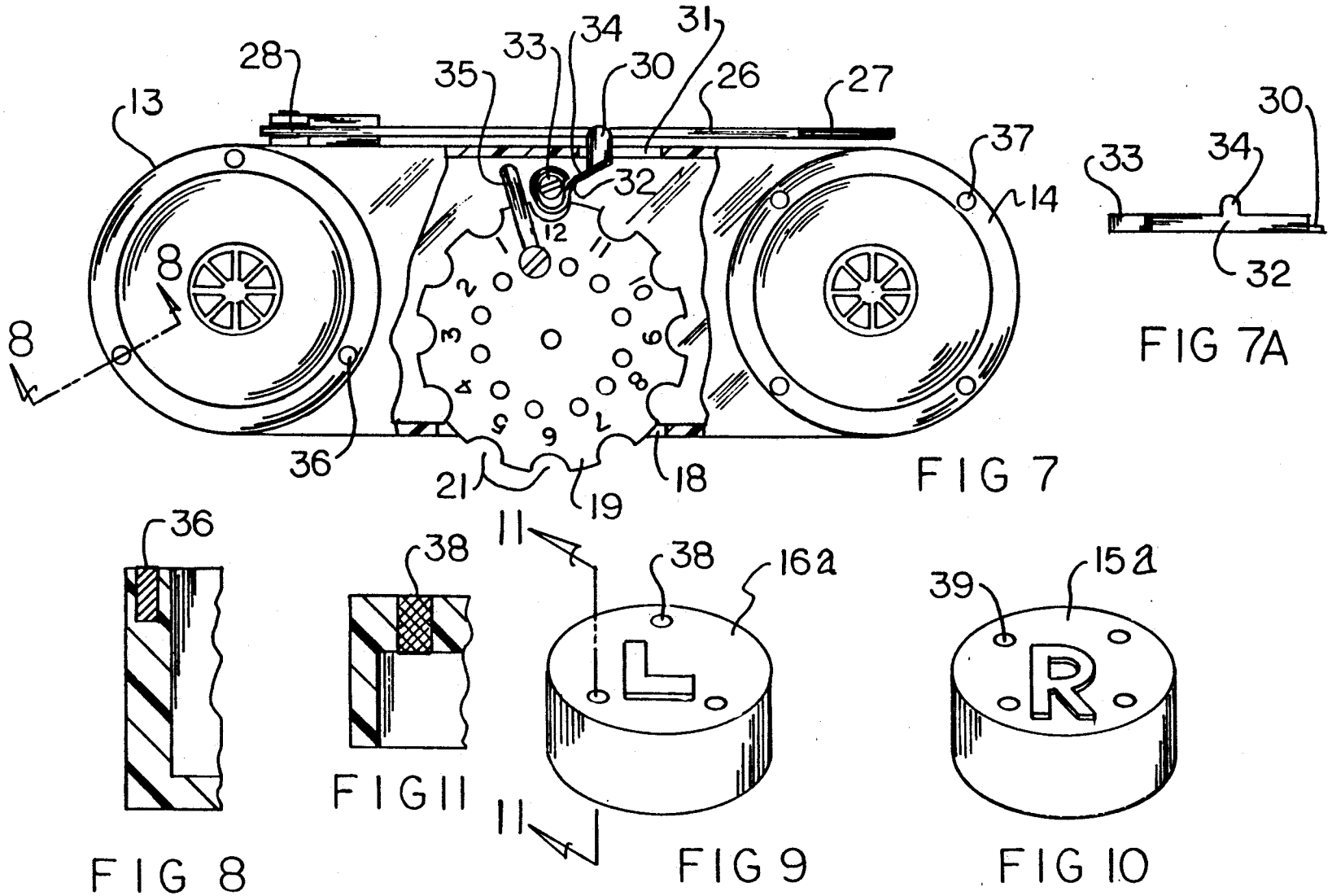
FIG. 7 is an orthographic view, partially in section, of the storage container, as set forth in FIG. 5.
FIG. 7*a* is an enlarged view of the latch plate spring plate structure, as indicated in FIG. 7.
FIG. 8 is an orthographic view, taken along the lines 8—8 of FIG. 7 in the direction indicated by the arrows.
FIG. 9 is an isometric illustration of a first lid structure as utilized by the container, as set forth in FIG. 7.
FIG. 10 is an isometric illustration of a second lid structure as employed by the organization, as set forth in FIG. 7.
FIG. 11 is an orthographic view, taken along the liens 11—11 of FIG. 9 in the direction indicated by the arrows.

The organization 10*a*, as indicated in FIGS. 5–11, indicates a modified aspect of the invention, wherein a signal rod 26 having a flag 27 mounted at a first end thereof is mounted to a spring hinge 28 at a second end of the rod 26 to maintain the rod in a second position, as indicated in FIG. 5, orthogonally oriented relative to the housing top wall 12 from a first position parallel to the top wall 12, as indicated in FIG. 5. A second slot 29 is directed through a second side wall of the housing 11, having a latch plate 30 projecting through the slot for overlying the signal rod 26. Reference to FIG. 7 indicates the operation of the organization, as indicated in the FIG. 5, wherein the latch plate 30 is mounted to a distal end of a latch plate spring plate 32 that is secured about a support post 33. An abutment tank 34 is mounted to an upper edge of the spring plate 32, wherein an abutment finger 35 mounted to the top surface of the rotary dial 19 intermediate the first and last enumerated notches 21 abuts the abutment tang 34 to displace the latch plate 30 from the signal rod 26 to permit the signal rod 26 to pivot to the second position, as indicated in FIG. 6. As the abutment tang 34 and the associated spring plate 32 displace, they will rotate sufficient to permit the abutment finger 35 to pass over the abutment tang 34 permitting the spring plate 32 to twist back to its original configuration, as indicated in FIG. 7*a* and FIG. 7. As illustrated, the abutment finger 35 will pass over the support post 33 and the spring plate 32 to engage the abutment tang 34. Upon this event, the passage of the last day of the sequence, as indicated by the rotary dial, provides for pivoting of the signal rod to the second position for further visual indication of the passage of the predetermined elapsed number of days available to an individual wearing disposable contact lenses to further indicate to that individual to dispose of such lenses and employ a further set.

The FIGS. 8–11 indicates the first container 13 having first container ferrous plugs 36, with the second container having second container ferrous plugs 37, each mounted to upper ends of each container. The first plugs 36 are of a first predetermined number, with the second plugs of a second predetermined number unequal to the first predetermined number. A modified first cap 15*a* includes first cap magnets 38, with each of the first cap magnets aligned with one of the first ferrous plugs 36 and one of the second cap magnets 39 equal to the second predetermined number aligned with one of the second ferrous plugs 37. In this manner, only the proper cap positioned upon the proper container will permit alignment of the first container ferrous plugs 36 to the first cap magnets 38 and similarly, the second ferrous plugs 37 aligned with the second cap magnets 39.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A contact lens date storage container, comprising,
a base housing, the base housing having a top wall spaced from and parallel a bottom wall, said top wall having a first end and a second end,
a first container orthogonally mounted to the top wall adjacent the first end of the top wall,
a second container orthogonally mounted to the top wall at the second end of the top wall, with the first container and second container arranged in a spaced relationship,
a first lid arranged for securement to the first container, and a second lid arranged for securement to the second container,
a housing cavity oriented between the top wall and the bottom wall,
a rotary dial mounted within the cavity,
the housing having a first side wall spaced from a second side wall, and a first slot directed through the first side wall and the rotary dial rotatably mounted within the cavity projecting through the first slot and the rotary dial having an annular edge,
spaced notches directed into the annular edge at equal intervals thereabout, and,
latch means arranged for selective engagement in one of said notches for securing the rotary dial in a predetermined rotary orientation within the cavity.

2. A storage container as set forth in claim 1 including a top wall window directed through the top wall, and each of the notches is oriented in adjacency to a respective digit, wherein the notches are arranged from a first notch to a penultimate notch, with a plurality of digits directed from a first digit oriented adjacent the first notch sequentially numbered to a penultimate digit arranged adjacent the penultimate notch, and each of said digits are sequentially viewed through the top wall window upon rotation of the rotary dial, wherein the rotary dial is rotatably mounted about a dial axle, and the dial axle is spaced from each of the digits a predetermined spacing, and the top wall window is spaced from the axle said predetermined spacing.

3. A storage container as set forth in claim 2 wherein the latch means includes a spring plate, the spring plate arranged for projection within one of said notches said spring plate having a spring plate first end and a spring plate second end, and the spring plate including a support post mounting the spring plate at said spring plate first end, with the spring plate second end including a latch plate, and a second slot directed through the second side wall, with the latch plate projecting through the second slot, and an abutment tang mounted to the spring plate, and an abutment finger mounted upon the rotary dial for engagement with the abutment tang to displace the spring plate and the latch plate, and displace the latch plate from the second slot, and a signal rod, the signal rod having a first end mounting a signal flag thereon, and the signal rod including a signal rod second end, with the signal rod second end including a spring hinge biasing the signal rod to a second position orthogonally oriented relative to the top wall from a first position substantially parallel to the top wall when the signal rod is positioned below the latch plate, whereupon displacement of the latch plate relative to the second slot displaces the latch plate from the signal rod permitting the signal rod pivot to the second position.

4. A storage container as set forth in claim 3 wherein the first container includes a first container upper edge, and the second container includes a second container upper edge, the first container upper edge includes a plurality of first container ferrous plugs of a first predetermined number, the second container upper edge having a plurality of second container ferrous plugs of a second predetermined number, and the first lid having a plurality of first magnets equal to said predetermined number, the second lid having a plurality of second magnets equal to said second predetermined number, wherein the first predetermined number is unequal to said second predetermined number.

* * * * *